US008827097B2

(12) United States Patent
Antal, Sr.

(10) Patent No.: US 8,827,097 B2
(45) Date of Patent: Sep. 9, 2014

(54) OVERCAP FOR A CONTAINER

(75) Inventor: Keith E. Antal, Sr., Valatie, NY (US)

(73) Assignee: Sonoco Development, Inc., Hartsville, SC (US)

( * ) Notice: Subject to any disclaimer, the term of this patent is extended or adjusted under 35 U.S.C. 154(b) by 132 days.

(21) Appl. No.: 13/004,125

(22) Filed: Jan. 11, 2011

(65) Prior Publication Data

US 2011/0168708 A1 Jul. 14, 2011

Related U.S. Application Data

(60) Provisional application No. 61/294,585, filed on Jan. 13, 2010.

(51) Int. Cl.

| | |
|---|---|
| ***B65D 51/16*** | (2006.01) |
| ***B65D 41/16*** | (2006.01) |
| ***B65D 43/02*** | (2006.01) |

(52) U.S. Cl.

CPC .. *B65D 51/1666* (2013.01); *B65D 2543/00435* (2013.01); *B65D 43/0212* (2013.01); *B65D 2543/00685* (2013.01); *B65D 2543/00296* (2013.01); *B65D 2543/0074* (2013.01); *B65D 2543/00027* (2013.01); *B65D 2543/00537* (2013.01); *B65D 2543/00796* (2013.01); *B65D 2543/00638* (2013.01); *B65D 2543/00092* (2013.01)

USPC ..... 220/203.09; 220/366.1; 220/785

(58) Field of Classification Search

USPC ..... 220/203.09, 785, 366.1, 201, 202, 220/203.01, 203.02, 203.07, 220/203.11–203.17, 203.26, 203.27, 215, 220/227

See application file for complete search history.

(56) References Cited

U.S. PATENT DOCUMENTS

| | | | |
|---|---|---|---|
| 2,953,272 | A | 9/1960 | Mumford et al. |
| 3,043,463 | A | 7/1962 | Beall, Jr. |
| 3,061,139 | A | 10/1962 | Pan |
| 3,181,720 | A | 5/1965 | Cassie et al. |
| 3,216,148 | A | 11/1965 | Amberg |
| 3,269,588 | A | 8/1966 | Ruckberg |
| 3,339,786 | A | 9/1967 | Biglin |
| 3,381,872 | A | 5/1968 | Holder et al. |

(Continued)

FOREIGN PATENT DOCUMENTS

DE 295 11 285 U1 11/1995

OTHER PUBLICATIONS

Search Report for EP application 11 15 0241.5, Dated Mar. 11, 2011.

*Primary Examiner* — Bryon Gehman
*Assistant Examiner* — Shawn M Braden
(74) *Attorney, Agent, or Firm* — Flaster/Greenberg, P.C.

(57) ABSTRACT

An overcap is provided for removably covering an access opening into the interior of a container. The opening in the container defines a peripheral rim and includes an outwardly projecting bead for releasably retaining the overcap. The overcap is defined by a body portion formed to cover the opening of the container and a depending skirt. The skirt extends from the bottom surface of the body portion for a distance sufficient to cover the projecting bead of the container rim. An inwardly directed retaining ring is formed on an inside surface of the skirt for engagement with the projecting bead on the container. A vent is formed within the retaining ring to define a flow path past the retaining ring. The vent may be a spacing rib formed on the inside surface of the skirt with one or more flow channels formed within the retaining ring.

28 Claims, 8 Drawing Sheets

(56) References Cited

U.S. PATENT DOCUMENTS

| | | | | |
|---|---|---|---|---|
| 3,559,843 | A | 2/1971 | Kern | |
| 3,595,467 | A | 7/1971 | Goglio | |
| 3,613,938 | A | 10/1971 | Westcott | |
| 3,679,089 | A | 7/1972 | Swett et al. | |
| 3,773,207 | A | 11/1973 | Dokoupil et al. | |
| 3,809,280 | A | 5/1974 | Park et al. | |
| 3,858,756 | A | 1/1975 | Fulton | |
| 4,154,360 | A | 5/1979 | Smith | |
| 4,190,170 | A | 2/1980 | Boyd | |
| 4,210,255 | A | 7/1980 | Pan | |
| 4,364,476 | A | 12/1982 | Weller et al. | |
| 4,522,298 | A | 6/1985 | Wienberger | |
| 4,705,188 | A | 11/1987 | Rahn | |
| 4,718,571 | A | 1/1988 | Bordner | |
| 4,760,936 | A | 8/1988 | Mueller | |
| 5,197,620 | A | 3/1993 | Gregory | |
| 5,326,176 | A | 7/1994 | Douke | |
| 5,377,858 | A | 1/1995 | Morris, Sr. | |
| 5,630,522 | A | 5/1997 | Montgomery | |
| 5,657,895 | A | 8/1997 | Rogge | |
| 5,722,562 | A | 3/1998 | Kick | |
| 5,785,196 | A | 7/1998 | Montgomery | |
| 5,894,953 | A * | 4/1999 | Ramirez | 220/785 |
| 5,975,346 | A | 11/1999 | Imperato et al. | |
| 5,992,635 | A | 11/1999 | Walters | |
| 6,041,982 | A | 3/2000 | Cautereels et al. | |
| 6,164,484 | A * | 12/2000 | Fiore et al. | 220/521 |
| 6,196,451 | B1 | 3/2001 | Helms | |
| 6,220,471 | B1 | 4/2001 | Lowry | |
| 6,230,924 | B1 | 5/2001 | Weiss et al. | |
| 6,478,183 | B1 * | 11/2002 | Bacon et al. | 220/784 |
| 6,502,710 | B1 | 1/2003 | Bösl et al. | |
| 6,725,630 | B2 | 4/2004 | Rea et al. | |
| 6,983,857 | B2 * | 1/2006 | Miller et al. | 215/270 |
| 7,017,775 | B2 | 3/2006 | Zettle et al. | |
| 7,074,443 | B2 * | 7/2006 | Thomas et al. | 426/118 |
| 7,156,252 | B2 | 1/2007 | Morin | |
| 7,169,418 | B2 | 1/2007 | Dalton et al. | |
| 7,169,419 | B2 | 1/2007 | Dalton et al. | |
| 7,294,354 | B2 | 11/2007 | Gunter et al. | |
| 7,311,218 | B2 | 12/2007 | Varadarajan | |
| 7,337,916 | B2 * | 3/2008 | Clougherty | 220/785 |
| 7,584,866 | B2 | 9/2009 | Selina et al. | |
| 7,594,588 | B2 | 9/2009 | Auer | |
| 7,886,928 | B2 * | 2/2011 | Mengeu | 220/366.1 |
| 2004/0195251 | A1 | 10/2004 | vonHoldt, Jr. | |
| 2004/0256348 | A1 | 12/2004 | Stevens et al. | |
| 2005/0236413 | A1 * | 10/2005 | Maciag et al. | 220/256.1 |
| 2007/0062948 | A1 | 3/2007 | Albrecht et al. | |
| 2009/0218351 | A1 | 9/2009 | Avtal, Sr. | |

* cited by examiner

OVERCAP FOR A CONTAINER

RELATED APPLICATION

The present application claims the benefit of the filing date of U.S. Provisional Application No. 61/294,585, filed Jan. 13, 2010.

FIELD OF THE INVENTION

The present invention relates to an overcap for sealing the top end of a container.

BACKGROUND OF THE INVENTION

Easy-open containers have been used for a variety of products, including powdered materials, such as food products, cleaning products, etc. Easy-open containers are often constructed of a composite cylindrical body portion having end closures for closing and sealing the container. In some examples, the top end closure comprises an end ring, fixed to the container body, and an inside circular peripheral rim in the form of an inwardly directed flange, which may include a downwardly curved bead. The inner rim defines a central opening of desired size for access through the rim and into the interior of the container. A removable membrane patch covers the central opening and may be attached to the inwardly extending flange. To open the container, the membrane patch is detached from the container, providing access to the product therein.

Easy-open containers often include overcaps, fitting over the container top end portion and top end closure. The overcap serves many functions including, but not limited to, protecting the top of the container from damage before and after removal of the membrane, keeping unwanted items from getting into the container, keeping the product within the container from spilling out, helping to improve stacking of the container, and increasing the life of the product after opening.

Some products, such as roasted or ground coffee, tend to give off gases for a period of time after their preparation. Ground coffee releases carbon dioxide and other gaseous substances for days or weeks after the grinding process. Because of this gas release, sometimes called "off-gassing", it is customary to store the coffee in packaging that can expand or that has a release vent on the package. Flexible packaging having a one-way gas release valve thereon is shown in, for example, Goglio U.S. Pat. No. 3,595,467, Donke U.S. Pat. No. 5,326,176 and Walters U.S. Pat. No. 5,992,635. Semi-rigid containers with vent valves are shown in, for example, Gunter et al U.S. Pat. No. 7,294,354 and Thomas et al U.S. Pat. No. 7,074,443.

When a flexible seal is provided on a more rigid container having materials subject to off-gassing, an amount of flexing occurs on the seal, prior to the provided valve venting the built up pressure within the container. In the Thomas et al patent mentioned above, the valve is provided on the flexible sealing material and a stand-off is provided on the underside of the overcap so that the valve may function properly. Another method of venting may be accomplished by positioning the valve on the membrane in a position that will prevent the valve from engaging the overcap during expansion of the flexible lid. In the Gunter et al patent mentioned above, the valve is provided on the outer surface of the container.

Another feature of overcaps for containers that is sometimes useful is a venting of pressure from within the container around the seal formed between the overcap and the rim or chime of the container. Various forms for causing this type of venting are shown in, for example, Clougherty U.S. Pat. No. 7,337,916, Holder et al U.S. Pat. No. 3,381,872 and Beall, Jr. U.S. Pat. No. 3,043,463.

SUMMARY OF THE INVENTION

An overcap is provided for combination with a container of the type having a container body defining an interior storage volume and an access opening into the container interior. The access opening of the container includes a peripheral rim and means for releasably retaining the overcap thereon. In one aspect of the invention, the overcap is defined by a body portion formed to cover the access opening of the container and having an outer periphery for overlapping the peripheral rim. A skirt depends form the outer periphery of the body portion. The skirt overlaps the peripheral rim of the container. A plurality of lugs is formed on the top surface, adjacent the outer periphery of the overcap body, and are formed a spaced intervals around the outer periphery. A plurality of flexure portions are formed on the outer periphery of the body portion and located within the spaced intervals between adjacent lugs.

In a further aspect of the overcap, a retaining ring may be formed on the skirt. The retaining ring is preferably dimensioned for resilient engagement of the retaining means of a container. In another aspect of the invention, one or more spacing ribs are formed on skirt and communicate with the retaining ring. The spacing ribs define a flow channel between the skirt and retaining means of a container and the flow channel extends through at least a portion of the retaining ring. The flow channels may include a pair of slots funned within a retaining ring, with one of each of the pair of slots positioned on an opposing side of the spacing rib at an intersection with the retaining ring.

In a further aspect of the overcap, a projecting standoff ring is provided on an upper surface of the body portion, opposite of the depending skirt. The standoff ring is preferably located inward of the position of the skirt and inward of the lugs. The standoff ring may be positioned inward of the peripheral rim of a container when the body portion is covering the access opening.

In a further aspect of the overcap, one or more vents may be formed on the depending skirt. The vents being active during engagement of the overcap and the container. The vents may be formed by one or more spacing ribs on the inside surface of the skirt, with the spacing ribs defining one or more flow channels along the inside surface of the skirt.

In a further aspect of the overcap, the lugs may be provided at equidistantly spaced intervals around the periphery of the body portion. The plurality of lugs may also be formed as a pair of raised ribs, with each of the raised ribs within the pairs being closely spaced to one another.

In a further aspect of the invention, an overcap and container combination is provided, with the container having a body portion defining an interior storage volume and an opening into the interior storage volume. The container includes an upstanding rim defining the access opening, an outwardly projecting bead formed on the upstanding rim. In addition, overcap includes a body portion having a covering portion formed to cover at least a portion of the access opening and extending outwardly beyond the position of the projecting bead on the upstanding rim of the container when the overcap body is positioned to cover the access opening. A depending skirt is provided and defines a periphery of the covering portion. The skirt extending from a bottom surface of the covering portion and beyond the projecting bead when the covering portion is positioned to cover the opening. An inwardly directed retaining ring is formed on an inside surface of the skirt. The retaining ring resiliently engages the projecting bead of the container body when the covering portion is positioned to cover the opening. A plurality of lugs are formed on the upper surface of the covering portion and are positioned radially outwardly of the standoff ring. The lugs are preferably positioned at spaced intervals around the periphery of covering portion of the body portion. Flexure portions are provided within the covering portion. The flexure portions are formed within space intervals between adjacent lugs and reactive to release internal pressure from within the container body when the covering portion is positioned in contact with the rim of the container body.

In a further aspect of the combination, a spacing rib is formed on the inside surface of the skirt and extending between the cover portion and the retaining ring. The spacing rib defines a flow channel between the skirt and the projecting bead, with the flow channel extending through the retaining ring.

In a further aspect of the combination, a projecting standoff ring is provided on an upper surface of the body portion of the overcap, on the opposite side from the depending skirt. The standoff ring is preferably positioned radially inward the position of the upstanding rim when the covering portion is positioned to cover the access opening.

In a further aspect of the combination, the distance of extension of the skirt from the body portion to the retaining ring is greater than the distance from the top of the peripheral rim to the outwardly projecting bead. Preferably, the distance of extension causes a separation of the retaining ring and the projecting bead of the container and defines a venting position wherein, during engagement of the retaining ring and the projecting bead, the first surface of the body portion is spaced from the rim of the container, one or more vent passages defined from the interior volume of the container, over the peripheral rim and through the retaining ring.

In a further aspect of the combination, one or more venting passages are formed by one or more spacing ribs positioned on the inside surface of the skirt. The one or more spacing ribs extend from the first surface of the body portion and intersect with the retaining ring. The spacing ribs form a flow channel adjacent to the ribs within the retaining ring. In a still further aspect of the combination, the flow channels are composed of comprise a pair of slots formed within the retaining ring, with one slot being positioned on opposite sides of the intersection of a rib and the retaining ring.

Further features and aspects of the contemplated invention are defined by the drawings and description below.

BRIEF DESCRIPTION OF THE DRAWINGS

For purposes of illustrating the invention, there is shown in the accompanying drawings a form which is presently preferred; it being understood, however, that the invention is not limited to the precise arrangements shown and instrumentalities shown.

DETAILED DESCRIPTION

Figure 1:
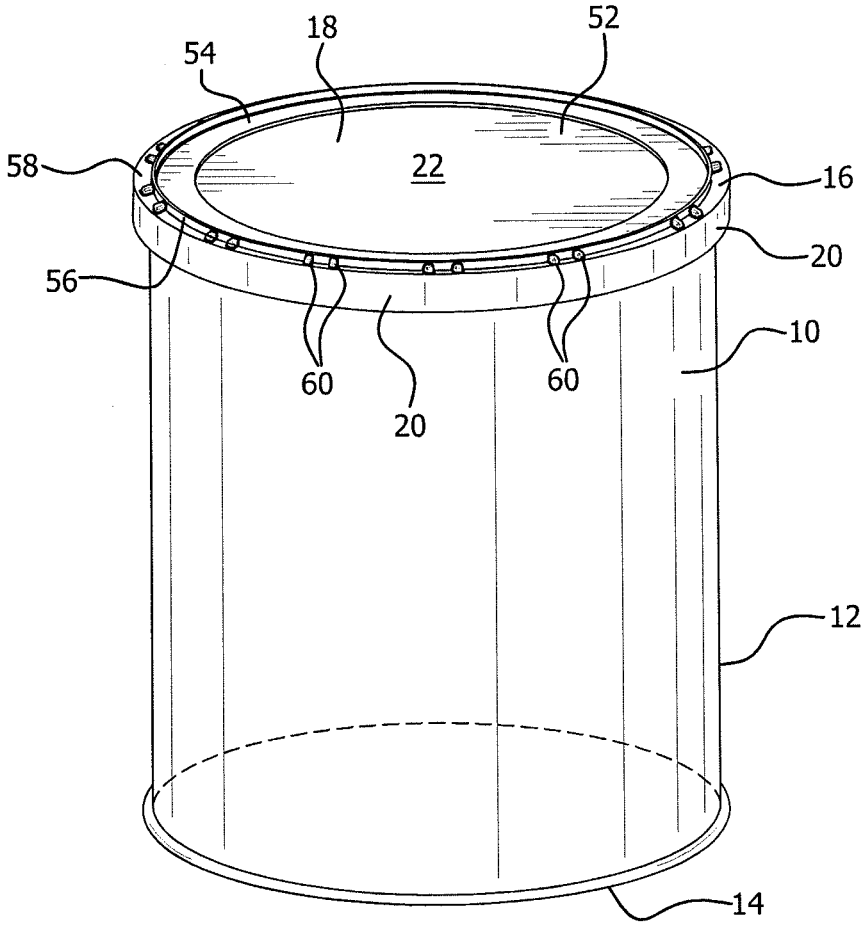
FIG. 1 is a perspective view of an embodiment of a container and overcap combination of the type contemplated by the present invention.

Referring now to the drawings, where like numerals identify like elements, there is shown in FIG. 1 a container, generally indicated by the numeral 10. The container 10 defines an internal volume and is adapted to be filled with a product (not shown), such as powdered or granulated food products, cleaning products, etc. In a preferred use of the contemplated invention, the container is used to retain ground coffee or other products that may cause off-gassing during their storage in the container. The container 10 may be of any desired configuration and may be constructed of any desired material including composites, plastic, metal, etc. It is preferred that the container be constructed of composite materials, including paper layers, of the type which are understood by those within the art. It is also preferred that the container have a generally cylindrical shape, although other shapes and profiles are contemplated.

As illustrated throughout the figures, the container 10 comprises a generally cylindrical container body 12 and a bottom wall 14. The side wall(s) that forms (form) the body 12 and the bottom wall 14 generally define the storage volume. The container 10 includes a top end, which is open, and is defined by an upstanding rim and defines an access into the container. A closure may be attached to the top end (discussed further below). The top end closure may be attached to the container body 12 in any known manner. The bottom wall 14 may also be defined by an attached closure member or may be integrally formed with the container body.

Attached to the top of the container 10 is an overcap 16 dimensioned and formed to cover the access opening of the container 10. The overcap 16 comprises a body portion 18 having a top wall and a depending, peripheral skirt 20. As illustrated in FIG. 1, the top surface 22 of the body portion 18 is visible, with the skirt 20 depending substantially perpendicular and downwardly from the body 18.

Figure 2:
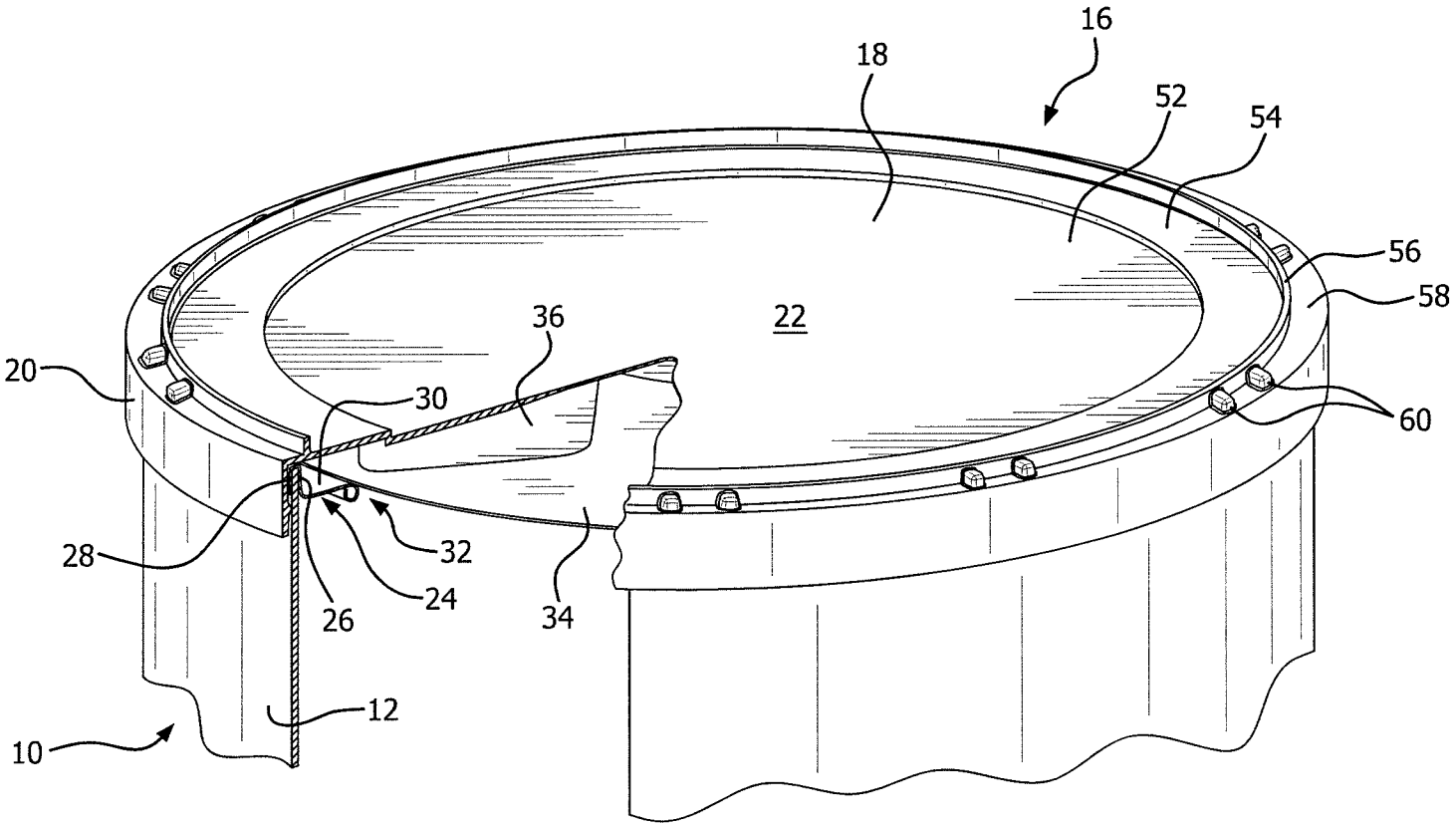
FIG. 2 is a partial cross sectional view of the top of the container and its engagement by overcap of FIG. 1.

In FIG. 2 there is shown a cut-away of the overcap 16 showing the interrelationship of the inside surfaces of the top wall of body 18 and skirt 20 with the upstanding of the side wall 12 of the container 10. Positioned on the upstanding rim of the body 12 is an annular ring 24 affixed to the edge of the container 10 (preferably by crimping or an equivalent method of attachment). The upper portion of the ring 24 forms a rim or chime 26 having an outwardly projecting bead 28 (shown more particularly in FIGS. 5A and 5B). The ring 24 also includes an inwardly directed flange 30 that defines an annular opening 32 into the interior volume of the container 10. The flange 30 is spaced relatively below the rim 26 and defines an annular planer surface. The skirt 20 of the overcap 16 extends from the body portion 18 for a sufficient distance to cover and extend beyond the bead 28 when the body 18 is covering the open end of the container.

A sealing membrane 34 is provided over the annular opening and is sealed (in a known manner) to the planer flange 30 of the ring 24. As illustrated, a one-way valve 36 is provided on the membrane 34. The valve 36 is contemplated to communicate with the interior volume of the container 10 when the membrane is sealed to the flange 30 of the ring 24. As shown, the valve 36 is positioned off-center on the membrane 34 so as to minimize any potential interference between the underside or bottom surface 38 (FIGS. 3 and 4) of the overcap 16 should the membrane 34 balloon outwardly due to off-gassing by the contents of the container 10. The membrane 34 is contemplated to be removable from the annular ring 24 to provide access to the contents through the access opening 32. The annular ring, membrane and vent valve may be of any known configuration and materials. Further, the membrane may be sealed directly to the rim of the container or any added ring structure.

Figure 3:
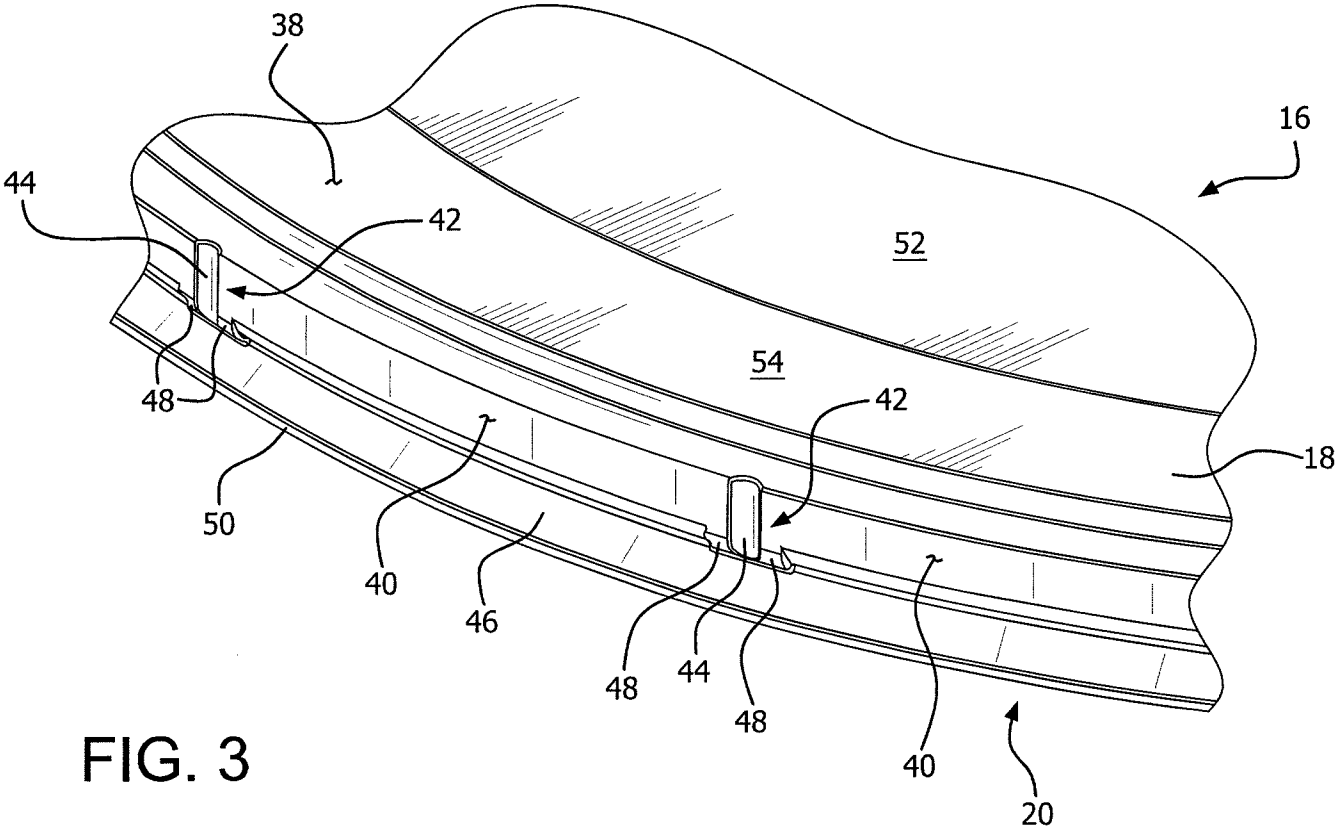
FIG. 3 is a perspective view of a portion of the underside of the overcap shown in FIGS. 1 and 2.
Figure 4:
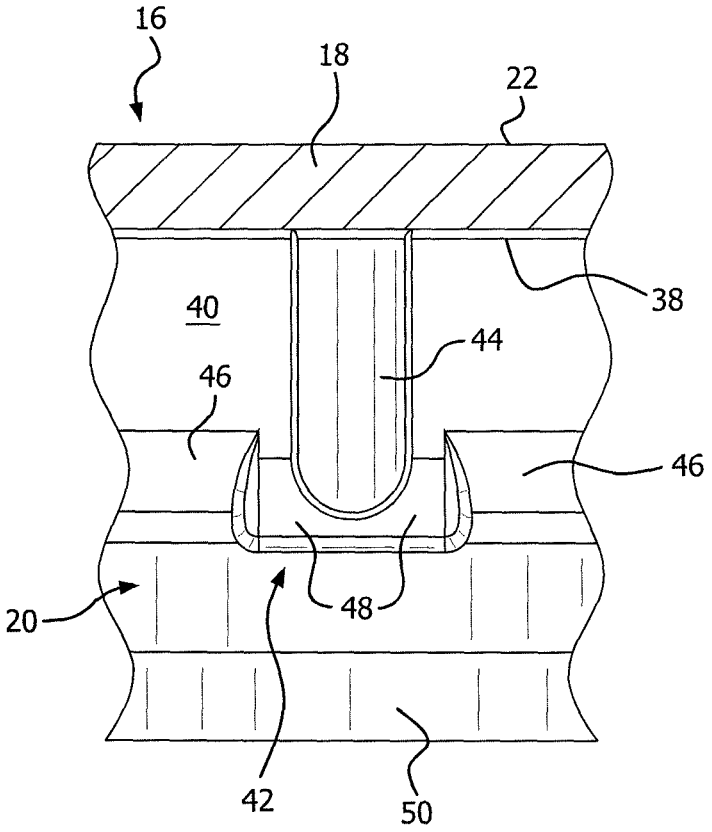
FIG. 4 is an elevation view of the underside of the overcap as shown in FIG. 3.

In FIGS. 3 and 4 there is shown views of vents 42 formed on the inside surface 40 of the skirt 20. Each vent 42 comprises a spacing rib 44 projecting inwardly from the inside surface 40 of the skirt 20. The spacing rib 44 starts at its upper end at the bottom surface 38 of the body 18 of the overcap 16. The spacing rib 44 runs along the skirt 20 to a position within the line of the means for retaining the overcap 16 on rim 26 of the container 10. As illustrated, the retaining means is in the form of a retaining ring 46. The retaining ring 46 is an annular projection on the inside surface 40 of the skirt 20 and is formed to create an interference fit with the outward projection of the bead 28 on the container rim 26 (FIG. 2), retaining the overcap 16 on the container 10. Other retaining means for engagement of an overcap on a projected rim of a container opening are known in the art and may be useful along with the features of the overcap as described herein. Two flow channels 48 are formed on opposite sides of the spacing rib 44. As illustrated, the flow channels extend partially through the retaining ring 46. The tail or bottom edge 50 of the skirt 20 extends downwardly from the retaining ring 46, away from the body 18 of the overcap 16.

Figure 5A:
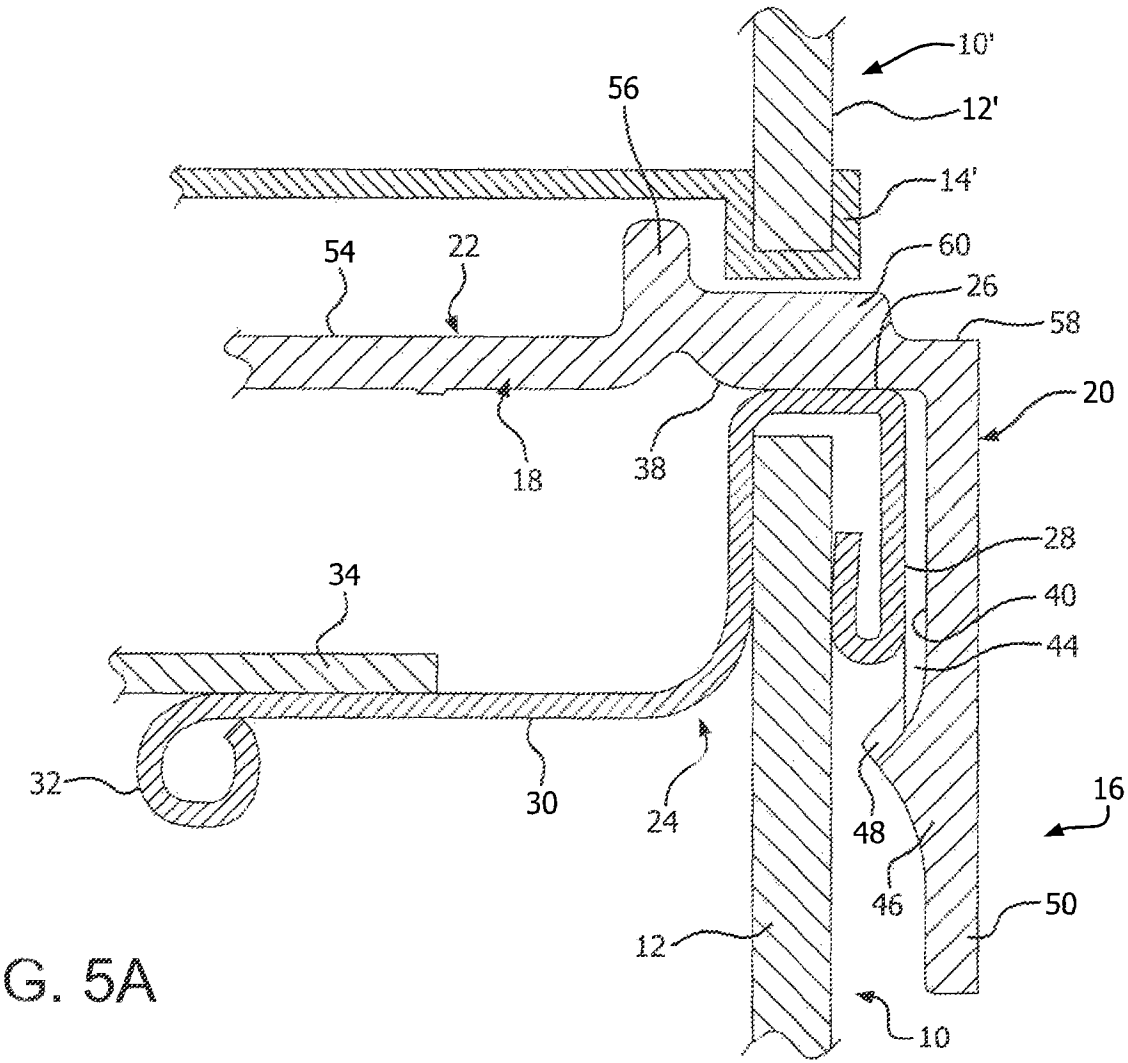
FIGS. 5A and 5B are cross sectional views of the engagement between the overcap and container in a resting position and in an active venting position.

In FIG. 5A, there is shown in cross section the relationship between the upper end of the container 10 and the overcap 16 in its normal or resting position on the container rim, covering the access opening into the container. As shown, the side wall of the container body 12 extends upwardly and is engaged by the annular ring 24. The rim 26 of the ring 24 is rolled over the edge of the container side wall or may be engaged in any known manner. The rim 26 forms an outwardly extending bead 28 on the outside surface of the side wall 12. The flange 30 extends inwardly towards the center of the container 10 and forms a central opening 32 into the internal volume. A sealing membrane 34 is attached to the flange 30 and covers the opening 32. The overcap 16 is fit over the top end of the container 10 with the body portion 18 resting on the rim 26. The annular skirt 20 extends downwardly from the peripheral edge of the body 18 and covers the bead 28. The overcap 16 is dimensioned to form an interference fit with the rim 26 and bead 28 combination, such that the retaining ring 46 on the inside surface 40 of the skirt 20 extends inwardly of the outside projection of the bead 28. The flexibility of the overcap 16 permits it to be removed from the rim 26 by a relatively low removal force.

The dimensions of the overcap 16 position the spacing rib 44 in contact with the outside surface of the bead 28. Thus, there is a space provided between the inside surface 40 of the skirt 20 and the outside surface of the bead 28 in the area of the channels 48 and above, where a spacing rib 44 is not present. In addition, the retaining ring 46 on the skirt 20 is positioned relatively below the lower end of the bead 28 in the resting position of FIG. 5A. Thus, a flow path is created between the inside surface 40 of the skirt and the lower end of the bead 28. This flow path communicates with the flow channels 48 formed within the retaining ring 46 on opposing sides of the spacing rib 44.

Figure 5B:
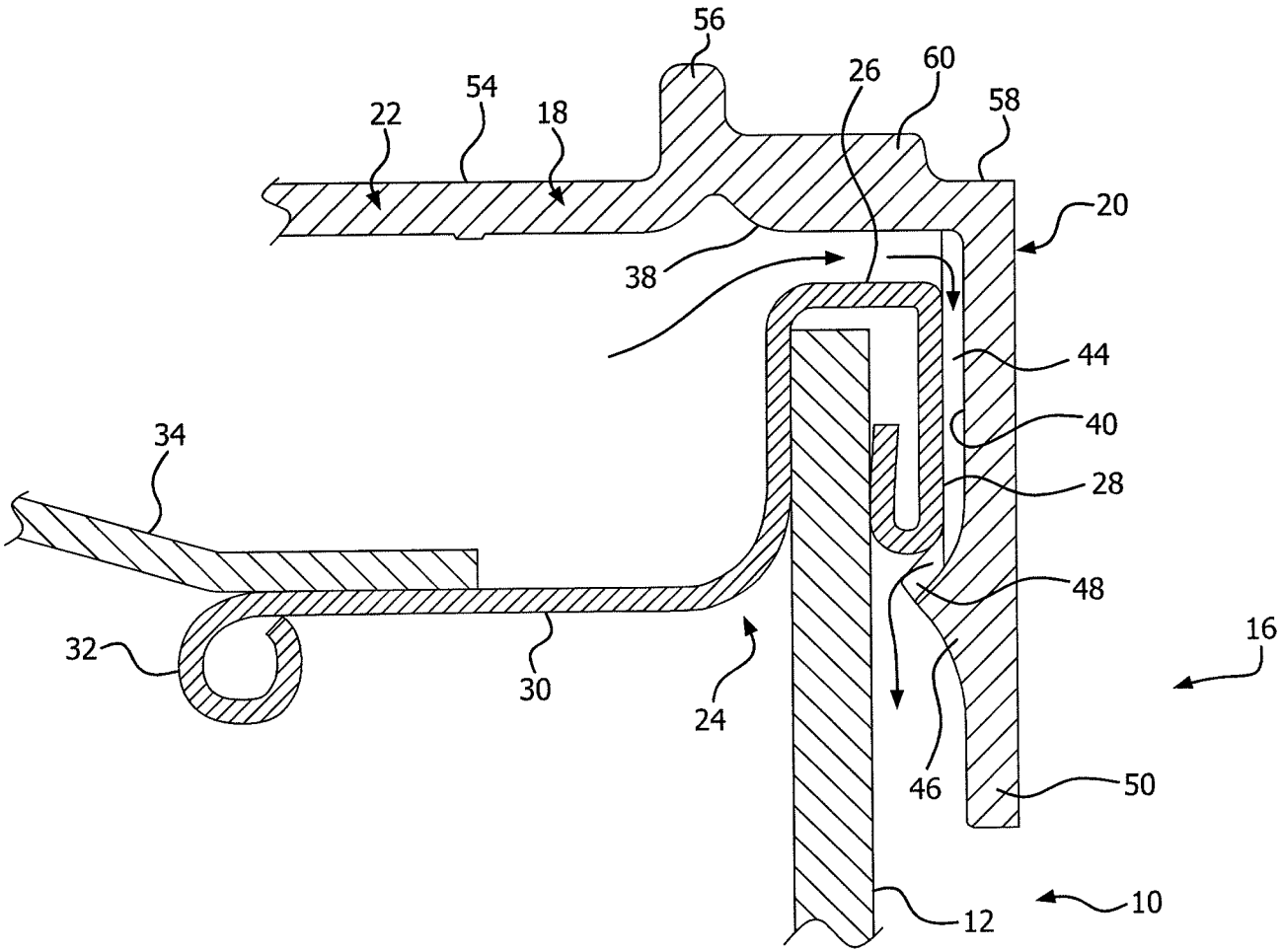

In FIG. 5B, there is shown a cross section of the interrelationship between the overcap 16 and the annular ring 24 on the upper end of the container 10 in a venting or active position. Because the present may be used where the product within the container 10 is subject to off-gassing, it is understood that a certain amount of pressure will build and may need to be vented to the outside environment. For example, during shipping, pressure will build within the internal volume of the container 10 and be retained by the sealing membrane 34 secured to the flange 30 of the ring 24. The venting valve 36 (FIG. 2) directs the gasses from internal volume into the space between the membrane 34 and the underside 38 of the overcap. The build-up of pressure may cause the overcap 16 to move upwardly from its normal rest position (FIG. 5A), creating a space between the bottom surface 38 of the overcap 16 and the top surface or chime of the rim 26 (FIG. 5B). The upward movement creates an extension of the flow path around the rim 26 and the bead 28. If the movement of the overcap 14 is sufficient to place the retaining ring 46 in contact with the bottom edge of the bead 28, the flow path is completed by the flow channels 48 on opposing sides of the spacing rib 44. The remaining portions of the retaining ring 46 serve to secure the overcap 16 on the top of the container 10. A similar function is created by the overcap 14 after the membrane 34 has been removed (to open the container 10) and the overcap 14 is replaced on the top end of the container 10 for storage of the remaining contents of the container 10.

In FIGS. 1 and 2, there is shown the top surface 22 of an overcap 16. In the embodiment shown, a series of surface elements are provided to further aid in the function of the overcap 16. The top surface of the overcap body 18 includes a central planer portion 52 that extends outwardly to a first raised annular area 54. A stand-off ring 56 is provided toward the outer periphery of the raised annular area 54. The stand-off ring 56 projects from the top surface 22 at a greater amount than the raised area 54. Outside of the stand-off ring 56 is provided a landing area 58 that forms the outer periphery of the body 18. Positioned at spaced locations on the landing area 58 is a plurality of lugs 60. As shown, the lugs 60 are provided in pairs, with each pair being equidistantly spaced around the landing area 58 on the perimeter of the top surface 22.

As shown in FIG. 5A, the outer periphery of the upper surface 22 of the overcap body 18 are shown in cross section. Moving from right to left, the upper surface 22 of the overcap 16 includes a landing area 58, with one of the lugs 60 shown in the cross section. Radially inward of the landing area 58 is the stand-off ring 56 and the raised annular area 54. (The central planer portion 52 is not shown in the partial view provided in FIG. 5A. This feature can be seen in FIGS. 1 and 2.) Positioned on top of the overcap 16 is the bottom end 14' of a second container 10'. The side wall of the body 12' is attached to the bottom wall 14', with the peripheral edge of the container resting on the lug 60. The stand-off ring 56 projects into a recess formed on the bottom wall 14' for lateral stability of the stacked containers 10 and 10'. The lug 60 supports the rim of the bottom wall 14' of the top container 10' so that it stands away from contact with the landing area 58.

The stacked relationship, as shown in FIG. 5A, is a typical condition where the containers are provided on pallets and similarly stacked for shipment or display. The weight of the top layer forces the overcap 16 onto contact with the rim 26 of the container 10 below, serving to resist upwards movement of the type shown in FIG. 5B. The lugs 60 provide a stand off for the relatively upper container 10' on the landing area 58 between the lugs 60. The areas between the lugs 60 are permitted to flex in response to pressure within the overcap to release gas into the flow path formed adjacent the spacing ribs 44 on the inside surface 40 of the skirt 20. In addition, the stand-off ring 56 on the upper surface 22 of the overcap body 18 is positioned radially inward (to the left in FIG. 5A) of the position of contact between the rim 26 of the container 10. Thus, the force created by a container or pallet resting on the stand-off ring 56 is not directly applied to the engagement of the bottom surface 38 of the overcap 16 and the rim 26 of the container 10. Again, a certain amount of flex is permitted by this offset positioning of the ring 56 with respect to the rim 26 of the container 10.

Figure 6:
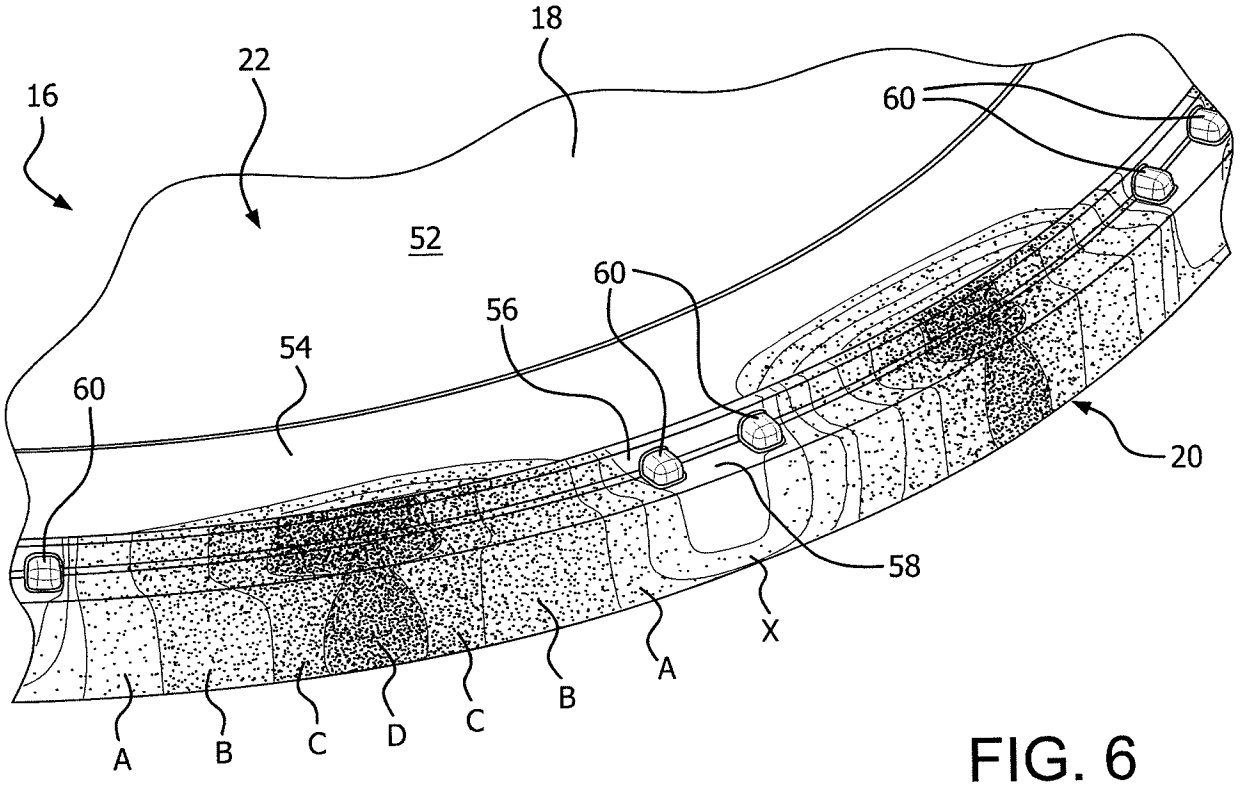
FIG. 6 is a perspective view of a portion of the top surface of the overcap as contemplated by the present invention.

As shown is FIG. 6, the formation of overcap 16 with lugs 60 on the outer landing area 58 of the top surface 22 of the overcap body 18 permits the flexing of the area of the overcap adjacent to the lugs. This flexing is illustrated by sections labeled A, B, C and D. The outer portions of the landing area 58, which are closely positioned to the lugs 60; are contemplated to flex the least. The section labeled D is centered between the spaced lug pairs 60 and is contemplated to flex the most, due to the distance of separation from the lugs 60 on each end of the area. Section B as illustrated is contemplated to have a greater flex than section A, while section C is contemplated to flex more than section B and less than section D. This pattern is contemplated to repeat around the periphery of the skirt 20, in the landing area 58 portions between the lug pairs 60.

Figure 7:
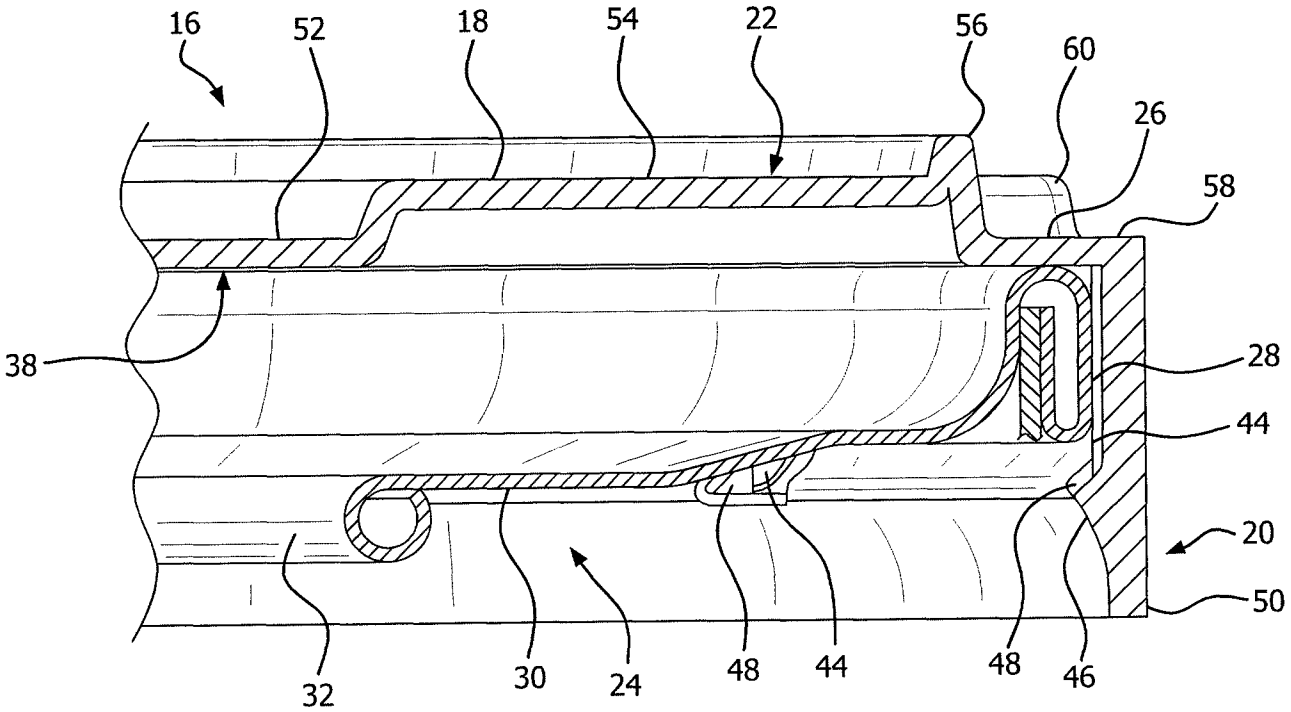
FIG. 7 is a partial cross sectional view of an embodiment of an overcap engaging the rim of the container.

In FIG. 7 is a partial cross section of another embodiment of an overcap and container rim combination. The overcap 16 in FIG. 7 is shown engaged with the annular ring 24 positioned on the tope end of the container (which is only partially shown). The body 18 of the overcap 16 includes a top surface 22 having a central portion 52, a radially outward raised portion 54, a raised stand-off ring 56 and a peripheral landing area 58. The raised portion 54 in FIG. 7 is relatively higher than the similar portion shown in the other figures, including the cross sections of FIGS. 5A and 5B. Lug members 60 are provided on the landing area 58, with one lug being shown in FIG. 7. A skirt 20 is provided on the peripheral edge of the body 18 and extends perpendicular from the bottom surface 38. The skirt 20 is in engagement with the chime or rim portion 26 of the annular ring 24 provided on the access opening into the container body 12. The rim 26 includes an outwardly extending bead 28, having a slightly different form that that particularly shown in the cross section of FIGS. 5A and 5B. A rib 44 is formed on the inside surface of the skirt 20 and extends downwardly to a position within retaining ring 46 and defines a flow path 48 around the outwardly extending bead 28 and the retaining ring 46 on the overcap 16. As illustrated, the venting flow path structures shown in FIG. 7 are the same as those shown in FIGS. 2-6 and these structures are intended to operate in the same manner.

The attached ring 24 on the projected rim of the container sidewall 12 as shown in FIG. 7 has a slightly different form than that shown in the other figures. The ring 24 defines a central opening 32 into the container interior volume. The opening 32 is defined inwardly from a flange portion 30 that connects to the rim portion 28 of the ring 24. The flange 30 in FIG. 7 is provided with multiple landing areas that are at different positions below the rim 28. This structure can be used, for example, to position the central opening 32 at a greater distance from the rim 28 and, thus, increasing spaced between the bottom surface 38 of the overcap 16 relative to the ring 32 and any sealing membrane (not shown in FIG. 7). The structures of FIG. 7 are contemplated to operate in the same general manner as those shown in the other figures.

It is contemplated that the thickness of the material used to form the overcap may be varied to further promote the flexing of the body of the cap adjacent to the landing area. It is preferred that the contact between the bead and the underside of the overcap be continuous in the normal or rest position. This contact will serve to create a seal to help preserve freshness, while permitting release of off-gas pressure build-up. Slots or grooves may be formed in the rim or underside of the overcap to create a normally open path, if desired.

The contemplated overcap is used to removably cover an access opening into the interior of a container. The container, opening and overcap may have a number of forms. The opening into the container defines a peripheral rim and includes an outwardly projecting bead for releasably retaining the overcap. The overcap in essence is defined by a body portion and a depending skirt. The skirt extends from the body portion for a distance sufficient to cover the projecting bead of the container rim. An inwardly directed retaining ring or similar engagement elements are formed on an inside surface of the skirt for engagement with the projecting bead adjacent to the container access opening. The vent formed within the overcap upon engagement of the container rim may have a number of structural elements. The vent is contemplated to define a flow path past the retaining ring during engagement of the bead and the retaining ring. The vent may include a spacing rib formed on the inside surface of the skirt, with one or more flow channels formed adjacent to the rib within the retaining ring. The vent may also include a flexing portion defined by the structures of the overcap. These structures may include lugs spaced along the peripheral surface of the overcap and/or a standoff ring formed radially inward of the engagement between the rim of the container access opening and the underside of the overcap. Other features and variations of these structures may also be included or combined with these structural elements without departing from the essence of the contemplated invention.

In the drawings and specification, there has been set forth a preferred embodiment of this invention and, although specific terms are employed, these terms are used in a generic and descriptive sense only and not for purposes of limitation. The scope of the invention is set forth in the following claims.

What is claimed is:

1. An overcap for a container having a container body defining an interior storage volume and an access opening into the interior storage volume, the access opening including an upstanding rim and means for releasably retaining the overcap thereon, the overcap comprising:

a body portion formed to cover the access opening of the container, the body portion having an upper surface, a bottom surface and an outer periphery, the bottom surface adjacent the outer periphery forming an overlapping portion for extending across the upstanding rim of the container, wherein the overlapping portion when in a rest position is in continuous contact with the upstanding rim of the container;

a skirt depending from the bottom surface adjacent the outer periphery of the body portion, the skirt dimensioned to cover the upstanding rim of the container when the bottom surface of the overlapping portion overlaps the upstanding rim of the container and the body portion covers the access opening of the container, a plurality of radially extending lugs formed on the upper surface of the overlapping portion, the lugs extending radially across the overlapping portion and extending from the upper surface in a direction opposite of the depending skirt, the plurality of lugs positioned at spaced intervals around the outer periphery, the lugs positioned for radially extending across the upstanding rim of the container, and a plurality of flexure portions formed within the overlapping portion, the flexure portions located in the spaced intervals between the radially extending lugs, wherein the flexure portions flex into an active position and are out of continuous contact with the upstanding rim of the container creating a flow path between the overlapping portion and the upstanding rim when the pressure inside of the overcap is greater than the pressure outside of the container.

2. An overcap for a container as in claim 1, further comprising a retaining ring formed on the skirt, the retaining ring dimensioned for resilient engagement of the retaining means of the container.

3. An overcap for a container as in claim 2, further comprising one or more spacing ribs formed on the skirt and communicating with the retaining ring, the one or more spacing ribs defining a flow channel between the skirt and retaining means of the container, the flow channel extending through at least a portion of the retaining ring.

4. An overcap for a container as in claim 1, further comprising a projecting standoff ring on an upper surface of the body portion, the standoff ring projecting in a direction that is opposite of the depending skirt.

5. An overcap for a container as in claim 4, wherein the standoff ring is positioned inward of the overlapping portion.

6. An overcap for a container as in claim 1, further comprising one or more vents formed on the depending skirt, the vents being active during engagement of the overcap and the container.

7. An overcap for a container as in claim 6, wherein the vents are formed by one or more spacing ribs on the inside surface of the skirt, the spacing ribs defining one or more flow channels adjacent the ribs along the inside surface of the skirt.

8. An overcap for a container having a container body defining an interior storage volume and an access opening into the interior storage volume, the access opening including an upstanding rim and means for releasably retaining the overcap thereon, the overcap comprising:

a body portion formed to cover the access opening of the container, the body portion having an upper surface, a lower surface and an outer periphery, the lower surface adjacent the outer periphery forming an overlapping portion for extending across the upstanding rim of the container;

a skirt depending from the lower surface adjacent the outer periphery of the body portion, the skirt dimensioned to cover the upstanding rim of the container when the lower surface of the overlapping portion overlaps the upstanding rim of the container and the body portion covers the access opening of the container;

a plurality of radially extending lugs formed on the upper surface of the overlapping portion, the lugs extending radially across the overlapping portion and extending from the upper surface in a direction opposite of the depending skirt, the plurality of lugs positioned at spaced intervals around the outer periphery, the lugs positioned for radially extending across the upstanding rim of the container;

a plurality of flexure portions formed within the overlapping portion, the flexure portions located in the spaced intervals between the radially extending lugs;

a retaining ring formed on the skirt, the retaining ring dimensioned for resilient engagement of the retaining means of the container; and one or more spacing ribs formed on the skirt and communicating with the retaining ring, the one or more spacing ribs defining a flow channel between the skirt and retaining means of the container, the flow channel extending through at least a portion of the retaining ring, wherein the flow channels comprise a pair of slots formed within a retaining ring, with one of each of the pair of slots positioned on an opposing side of the spacing rib at an intersection with the retaining ring.

9. An overcap for a container as in claim 8, wherein the lugs are positioned at equidistantly spaced intervals on the overlapping portion.

10. An overcap for a container as in claim 9, wherein the lugs are formed as pairs of raised ribs, wherein the raised ribs within each of the pairs are closely spaced to one another and wherein the flexure portions are located between the raised rib pairs.

11. An overcap and container combination comprising a container having a body portion defining an interior storage volume and an access opening into the interior storage volume, the container body having an upstanding rim defining the access opening, and an outwardly projecting bead formed on the upstanding rim; and an overcap having a body portion, the overcap body portion having a covering portion formed to cover at least a portion of the access opening, a peripheral portion for overlapping the upstanding rim and extending outwardly beyond the projecting bead on the upstanding rim of the container when the overcap body portion is positioned to cover the access opening, a skirt depending from the peripheral portion of the overcap, the skirt extending from a bottom surface of the peripheral portion and covering the projecting bead when the covering portion is positioned to cover the access opening, an inwardly directed retaining ring formed on an inside surface of the skirt, the retaining ring resiliently engaging the projecting bead of the container body when the covering portion is positioned to cover the access opening, a plurality of lugs formed on an upper surface of the covering portion, the lugs projecting upwardly from the peripheral portion and extending radially across a portion of the peripheral portion, the lugs positioned at spaced intervals around the peripheral portion, and flexure portions within the peripheral portion, the flexure portions formed within the spaced intervals between adjacent lugs, the flexure portions being reactive to release internal pressure from within the container body when the covering portion is positioned to cover the access opening and the peripheral portion is in contact with the upstanding rim of the container body.

12. An overcap and container combination as in claim 11, further comprising one or more spacing ribs formed on the inside surface of the skirt, the spacing ribs intersecting the retaining ring and defining a flow channel between the skirt and projecting bead, the flow channel extending through the retaining ring.

13. An overcap and container combination as in claim 11, further comprising a projecting standoff ring on an upper surface of the covering portion, the standoff ring projecting from the container body in a direction opposite of the depending skirt, the standoff ring positioned radially inward of the peripheral portion and positioned inward of the upstanding rim when the covering portion is positioned to cover the access opening.

14. An overcap and container combination as in claim 11, wherein the skirt has a length extending from the bottom surface to the retaining ring, the skirt length being greater than the distance from a top edge of the peripheral rim to a bottom edge of the outwardly projecting bead.

15. An overcap and container combination as in claim 14, wherein a plurality of spacing ribs are provided on an inside surface of the skirt, the plurality of spacing ribs each intersecting with the retaining ring, and a flow channel formed adjacent each of the spacing ribs within the retaining ring.

16. An overcap and container combination as in claim 15, wherein the flow channels comprise a pair of slots formed within the retaining ring, with one slot positioned on opposite sides of the intersection of the spacing ribs and the retaining ring.

17. An overcap for a container having a container body defining an interior storage volume and defining an access opening into the interior storage volume, the access opening including a peripheral rim having an outwardly projecting bead, the overcap comprising:

a body portion formed to cover the access opening of the container;

a depending skirt formed on an outer periphery of the body portion, the skirt extending substantially perpendicular from a first surface of the body portion for a distance sufficient to cover and extend beyond the projecting bead when the body portion is in a resting position on the peripheral rim of the access opening of the container, an inwardly directed retaining ring formed on an inside surface of the skirt, the retaining ring resiliently engaging the projecting bead during placement of the overcap on the peripheral rim of the container, a vent formed within the retaining ring, the vent being active during engagement of the bead and the retaining ring, the vent is formed by a spacing rib formed on the inside surface of the skirt, the spacing rib intersecting with and extending through the retaining ring, and a flow channel formed adjacent to the spacing rib within the retaining ring, a projecting standoff ring formed on a second surface of the body portion, the standoff ring projection in a direction opposite of the depending skirt, the standoff ring positioned inwardly of the position of the skirt and positioned inwardly of the position of the peripheral rim of the container when the body portion is in engagement with the peripheral rim.

18. An overcap as in claim 17, wherein the spacing rib extends from the body portion along an inside surface of the skirt to the intersection with the retaining ring.

19. An overcap as in claim 18, wherein the flow channel comprises a pair of slots formed within the retaining ring, with one slot positioned on opposite sides of the intersection of the spacing rib and the retaining ring.

20. An overcap as in claim 17, further comprising a plurality of radially extending lugs formed on the second surface of the body portion at positions radially outward of the standoff ring, the lugs being spaced from one another.

21. An overcap as in claim 20, wherein the lugs are equidistantly spaced around the periphery of the body portion.

22. An overcap as in claim 21, wherein the lugs are formed as pairs of raised ribs, wherein the raised ribs within each pair are closely spaced with one another and wherein the pairs of raised ribs are equidistantly spaced around the periphery.

23. An overcap as in claim 17, wherein the distance of extension of the skirt from the body portion to the retaining ring is greater than the distance from the top of the peripheral rim to the outwardly projecting bead.

24. An overcap as in claim 23, wherein the distance of extension of the skirt causes a separation of the retaining ring and the projecting bead of the container and defines a venting position wherein, during engagement of the retaining ring and the projecting bead, the first surface of the body portion is spaced from the rim of the container, and a vent passage is defined through the retaining ring.

25. An overcap as in claim 24, wherein the vent is formed by a spacing rib positioned on the inside surface of the skirt, the spacing rib extending from the first surface of the body portion and intersecting with the retaining ring, and a flow channel is formed adjacent to the spacing rib within the retaining ring.

26. An overcap as in claim 25, wherein the flow channel comprises a pair of slots formed within the retaining ring, with one slot positioned on opposite sides of the intersection of the spacing rib and the retaining ring.

27. An overcap as in claim 26, wherein the slots extend through a portion of the retaining ring.

28. An overcap as in claim 27, wherein a plurality of flow channels are formed by a plurality of spacing ribs positioned at spaced locations around the inner periphery of the skirt and each intersecting the retaining ring.

* * * * *